US006817051B2

(12) United States Patent
Tanner

(10) Patent No.: US 6,817,051 B2
(45) Date of Patent: Nov. 16, 2004

(54) GUIDE APPARATUS FOR A WORKPIECE HAVING A POROUS SURFACE COATING AND A METHOD FOR THE POLISHING OF SUCH A WORKPIECE

(75) Inventor: Bruno Tanner, Winterthur (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 10/447,560

(22) Filed: May 28, 2003

(65) Prior Publication Data

US 2004/0043231 A1 Mar. 4, 2004

(30) Foreign Application Priority Data

Aug. 27, 2002 (EP) ..... 02405726

(51) Int. Cl.[7] ..... B24B 31/00

(52) U.S. Cl. ..... 15/1.7; 15/3.15; 451/66; 451/106

(58) Field of Search ..... 428/332, 337, 428/409, 601; 29/90.01; 451/113, 28, 66, 29, 106; 15/1.7, 3.15

(56) References Cited

U.S. PATENT DOCUMENTS

| | | | | |
|---|---|---|---|---|
| 1,482,923 A | | 2/1924 | Goke et al. | |
| 4,234,397 A | * | 11/1980 | Torrey | 205/661 |
| 4,361,989 A | * | 12/1982 | Ohno | 451/328 |
| 4,447,992 A | | 5/1984 | Bergquist | |
| 6,165,600 A | | 12/2000 | Murphy et al. | |

FOREIGN PATENT DOCUMENTS

| | | |
|---|---|---|
| CH | 169778 A | 6/1934 |

* cited by examiner

*Primary Examiner*—Jennifer McNeil
(74) *Attorney, Agent, or Firm*—Townsend and Townsend and Crew, LLP

(57) ABSTRACT

The guide apparatus in accordance with the invention for the guiding of a workpiece (2), in particular of a rotationally asymmetrical workpiece (2), having a porous surface coating (3) in a polishing container (4) has two guide members (6) spaced apart by at least one spacer (5) as well as a holder (7) for the positioning of the workpiece (2) between the two guide members (6) such that the workpiece (2) can be guided in the polishing container (4) in a non-contact manner with respect to the polishing container (4).

14 Claims, 5 Drawing Sheets

GUIDE APPARATUS FOR A WORKPIECE HAVING A POROUS SURFACE COATING AND A METHOD FOR THE POLISHING OF SUCH A WORKPIECE

BACKGROUND OF THE INVENTION

The invention relates to a guide apparatus for the guiding of a workpiece having a porous surface coating in a polishing container, to a method for the polishing of a porous surface layer as well as to the use of the method for the polishing of a porous heat insulating layer of a turbine vane and to a turbine vane polished in accordance with the method of the invention.

A whole series of different processes are known for the polishing of surface layers of workpieces, depending on the application, material and structure of the surface layer. The purpose of the polishing frequently consists of reducing the roughness of the surface in addition to a pure removal of material at the surfaces. This can be desired, for example, for purely aesthetic reasons, for instance to produce glossy surfaces, or it can be required due to technical demands, for example to reduce coefficients of friction, to minimize the adhesion or inclusion of foreign particles such that a required porosity of the surface is maintained, or to prevent soiling of the surface. In the art, as a rule, the roughness of the surface of a solid is characterized by different roughness measuring parameters which can be found in the corresponding technical literature. One of these roughness measuring parameters is the so-called "average roughness value $R_a$" which, as the mean deviation of the absolute amounts of the roughness profile from a central line within a pre-settable measuring path, is a measure for the roughness of a surface and which is given, in dependence on the degree of the roughness, in micrometers ($\mu$m) for example.

As already mentioned, different methods are used, depending on the application, for the reduction of the roughness of a surface. For instance, turbine vanes for airplane turbines or for land-based gas turbines for the generation of electrical energy are provided, for example, with layers of metallic alloys, in particular with MCrAlY layers, with M standing for a metal such as nickel (Ni), cobalt (Co) or iron (Fe) and CrAlY (chromium, aluminum, yttrium) designating a super alloy very familiar for this and other purposes. These layers can, for example, be applied in a vacuum chamber in a thickness between 50 $\mu$m and 250 $\mu$m, with a surface roughness $R_a$ typically being achieved of approximately 6 $\mu$m–12 $\mu$m. Furthermore, it is frequently necessary to provide the aforesaid MCrAlY layers with a heat insulating layer which the person skilled in the art also frequently calls a TBC coating (thermal barrier coating). Such TBC coatings can be manufactured, for example, on a zirconia ($ZrO_2$) basis, with—in a typical example—the heat insulating layer being able to be approximately 100 $\mu$m up to 500 $\mu$m thick, in special cases more than 1 mm and substantially including 92% $ZrO_2$ and 8% yttrium oxide $Y_2O_3$ for stabilization. The grain sizes of the grains making up the layer can lie, for example, between 45 $\mu$m and 125 $\mu$m, with a porosity of the heat insulating layer being typically reached at between 5% and 20%. Typical values for the roughness of TBC coatings are found in the range from 9 $\mu$m up to 16 $\mu$m. It should be pointed out at this point that the aforesaid parameters of the layers, as well as their chemical composition, can differ considerably from the previously cited examples in a specific case.

The surface roughnesses which the layers show after the application to the workpiece are, however, frequently not acceptable and must be reduced, for example, by polishing.

In the example important for practice of turbine vanes for land-based turbines, values are required for the surface roughness $R_a$ of max. 6 $\mu$m, preferably, however, less than 4 $\mu$m, in particular in order to prevent increased soiling and to improve flow dynamics.

With MCrAlY layers, or generally with metallic or metal alloy surfaces, the required surface roughness can be achieved using different methods, with—analogous to classical sandblasting—abrasive blasting techniques, for example with fine corundum, shot peening or cut-wire peening with hard steel bodies, with rust-free steel bodies or with ceramic blasting bodies, being customary. To achieve the highest possible surface qualities, i.e. minimum roughness and/or uniform roughness of material surfaces, various methods are available for vibropolishing in combination with polishing elements with an abrasive action.

However, only the last mentioned methods of vibropolishing are used for the polishing of most TBC layers, since they treat the surfaces sufficiently gently in the polishing process such that damage in the form of micro-tears, peeling of surface regions or similar damage in the porous TBC coatings can be avoided.

Two variants of polishing apparatuses are widely used for the carrying out of the vibropolishing, namely so-called round vibrators and tray vibrators. A tray vibrator is an apparatus which substantially includes a polishing container, which includes corresponding polishing elements and which can be set into vibration by suitable devices. The workpieces to be treated are, in the simplest case, placed into the polishing container such that the workpieces are polished by the polishing elements which behave overall under vibration in an analogous manner to a viscid liquid. Partitioning slides can be provided which prevent adjacent workpieces from touching or damaging one another in the polishing container and an external attaching of the workpieces can also be provided. A masking of specific surface regions of the workpiece with covers, in particular made of plastic, can also provide a further protection such that only a partial smoothing of the workpiece is allowed and/or, for example, endangered edges are protected.

These apparatuses known from the prior art have disadvantages which result in unsatisfactory results in particular in the polishing of rotationally asymmetrical workpieces and/or of workpieces having porous surfaces such as turbine vanes with TBC coatings.

For instance, unacceptably high mechanical strains can act on externally clamped workpieces treated in a tray vibrator which, in the worst case, can result in damage to the workpiece and/or to the surfaces to be treated, in particular to porous and/or brittle surfaces. If the workpieces to be polished are placed directly into the polishing container of the tray vibrator in accordance with the prior art, that is, without an external fastening, the risk exists that the workpiece can come into direct contact with the walls of the tray vibrator or with any possibly present partitioning slides and/or with adjacent workpieces, whereby damage to the workpiece or to sensitive regions of the surface of the workpiece, in particular at edges, cannot be precluded. The risk in particular exists that, for example, a distance of less than two polishing elements is adopted between the workpiece surface and an adjacent bounding wall such that a polishing element is jammed between the workpiece surface and an adjacent bounding wall, which can result in enormous point strains on the surface of the workpiece.

Damage of the previously described kind can admittedly be reduced by suitable masking of endangered surface regions. However, this is only possible for those surface regions which do not have to be polished. In addition, this method is very complex in practice since frequently more than one surface region has to be protected separately in each case by a suitable masking, which is associated with a complex installation or removal of the corresponding parts and is thus less efficient from an economic viewpoint. A further substantial disadvantage is the fact that, in particular with rotationally asymmetrical workpieces such as turbine vanes for land-based applications, the known methods result in insufficient surface roughnesses and/or in particular in non-uniformly polished regions, i.e. regions with non-uniform roughness on the surface of the workpiece. Due to the asymmetrical mass distribution, for example of a turbine vane, the turbine vane will only rotate non-uniformly between the polishing elements in the polishing container and the differently oriented surfaces of the turbine vane are acted upon by the polishing elements with different polishing pressures during polishing, which ultimately results in different regions of the surface having different surface roughnesses, and in a sufficiently high roughness not being reached at all at certain surfaces of the turbine vane. What was said above is also true in another respect for polishing methods in which the workpiece is externally fastened. The previously described disadvantages do not only occur on the polishing of turbine vanes, for which the problems are explained here by way of example, but also occur generally in vibropolishing, in particular with rotationally asymmetrical workpieces.

SUMMARY OF THE INVENTION

It is therefore an object of the invention to provide a different apparatus and a different method for the polishing of a surface of a workpiece, in particular of a porous surface of a rotationally asymmetrical workpiece.

A guide apparatus made in accordance with the invention for the guiding of a workpiece, in particular of a rotationally asymmetrical workpiece, has a porous surface coating in a polishing container has two guide members spaced apart by at least one spacer member, as well as a holder for the positioning of the workpiece between the two guide members such that the workpiece can be guided in a non-contact manner in the polishing container with respect to the polishing container.

The apparatus in accordance with the invention thus allows a workpiece, in particular a workpiece having a porous surface coating, to be guided, for example, in a tray vibrator during a polishing process, with it being possible to dispense with external fastening means for the guiding of the workpiece. Among other things, external strains can thus be avoided which, in the worst case, can result in damage to the workpiece and/or to the porous surfaces to be treated. It is avoided by the guide apparatus in accordance with the invention that the workpiece to be polished can come into direct contact with any partitioning slides which may be present and/or with adjacent workpieces, whereby damage to the workpiece, or to sensitive regions of the surface of the workpiece, in particular at edges, is largely precluded. Moreover, in particular rotationally asymmetrical workpieces such as turbine vanes can be polished uniformly by use of the guide apparatus in accordance with the invention. This is achieved in that a uniform rotational movement of the workpiece can be achieved on polishing by the design of the guide apparatus even with an asymmetrical mass distribution of the workpiece such as with a turbine vane, such that the workpiece is acted upon by the polishing elements with a substantially uniform polishing pressure, which ultimately results in different regions of the surface having approximately the same surface roughnesses and in a sufficiently low roughness being able to be reached at all surfaces of the turbine vane to be polished.

The guide apparatus includes for this purpose at least two guide members which are spaced apart by at least one spacer member. Furthermore, the guide apparatus has a holder for the positioning of the workpiece between the guide members, with the guide members being arranged and designed such that the workpiece can be guided in a non-contact manner in the polishing container with respect to the bounding walls of a polishing container in which the workpiece is polished, preferably by vibropolishing.

The holder, which is suitable for the positioning of the workpiece in the guide apparatus, can include a cover member in a preferred variant which allows a region of the surface of the workpiece, which should not be polished, to be covered, with the cover member preferably being able to be made of a suitable plastic, but, depending on the requirements, also of other materials such as of a metal or of a ceramic material. It is generally possible for a plurality of cover members to be provided for the covering of different regions of the workpiece which do not have to be part of the holder. The holder and/or the cover member can expediently be made in two or more parts such that the workpiece can be installed in a simple manner in the holder and/or in the cover member. The holder and/or the cover members are preferably fastened to one or more guide members and/or to one or more spacers, preferably by fastening means. The fastening members can, for example, be clamped by elastic plastic bands, by metal bands which are clamped with the aid of suitable devices for the fixing of the workpiece, or can also be realized, for example, by screws or any other suitable fastening means, with the cover member and/or the holder also being able to be designed in one part.

In a particular variant of the guide apparatus in accordance with the operation, it is also possible for a plurality of holders to be provided for the positioning of the workpiece. For instance, the workplace can be suitably positioned between the spacers at the same time, for example, by a plurality of holders of which a respective one or more is/are fixed to a respective guide member and/or to a spacer.

The guide members are preferably designed in ring shape or in the form of a circular disc, with the guide members being arranged parallel to one another by the spacers and being designed such that the guide apparatus is freely rotatable about a longitudinal axis and the workpiece can be guided in the polishing container such that the workpiece does not come into contact with the bounding walls of the polishing container. The guide apparatus is preferably arranged in the polishing container such that the longitudinal axis of the guide apparatus, about which the guide apparatus is freely rotatable, stands substantially perpendicular to the direction of the acting gravity; i.e. the longitudinal axis of the guide apparatus is preferably arranged in the horizontal direction in the polishing container. It is also possible to position the guide apparatus in any other desired orientation in the polishing container.

In the method in accordance with the invention for the polishing of porous surface coatings of a workpiece, in particular of a rotationally asymmetrical workpiece, the workpiece is guided by means of a guide apparatus in a polishing container, with the guide apparatus having two guide members spaced apart by at least one spacer as well as a holder for the positioning of the workpiece between the two guide members. The workpiece is guided in the polishing container in a non-contact manner with respect to the polishing container.

The polishing of a workpiece is preferably carried out in a vibration polishing method, for example by vibropolishing, with the aid of polishing elements.

The polishing container, which contains polishing elements known per se in a known manner, is set into vibration by likewise known devices such that the workpiece fixed in a guide apparatus, which is suitably positioned in the polishing container, is polished by the unordered movement of the polishing elements which behave as a whole in an analogous manner to a viscid liquid. Pyramid-like or tetrahedron-like polishing elements made, for example, of steel, corundum or other suitable materials with typical dimensions in the range of some millimeters can be used as the polishing elements. Polishing elements of a different size or made of different materials can also be used advantageously.

Due to the design of the guide apparatus in accordance with the invention, the guide apparatus preferably also carries out rotational movements about a longitudinal axis in the polishing process in a polishing container with rotationally asymmetrical workpieces such as turbine vanes such that a uniform roughness of the polished surfaces, in particular of the polished porous heat insulating layers (TBC layers), is achieved.

The guide apparatus in accordance with the invention is preferably used for the polishing of turbine vanes having yttrium stabilized heat insulating layers based on $ZrO_2$. Such ceramic heat insulating layers typically include 92% $ZrO_2$, 8% $Y_2O_3$, with the grain sizes typically lying between 45 $\mu$m and 125 $\mu$m in the heat insulating layer with a porosity from 5% to 20%.

In a preferred embodiment of the method in accordance with the invention for the polishing of porous surface layers, a rotationally asymmetrical turbine vane is fixed in a holder which simultaneously acts as a cover member, with the cover member preferably being made in two parts such that the turbine vane can be installed into and removed from the holder or cover member in a simple manner.

The guide apparatus in accordance with the invention, as well as the method in accordance with the invention, are in particular used for the polishing of a porous heat insulating layer (TBC layer) of a turbine vane, with the turbine vane with a porous heat insulating layer polished in accordance with the invention having a surface roughness of less than 15 $\mu$m, in particular of less than 8 $\mu$m, specifically less than 4 $\mu$m.

The invention will be explained in more detail in the following with reference to the drawing.

DESCRIPTION OF THE PREFERRED EMBODIMENTS

Figure 1:
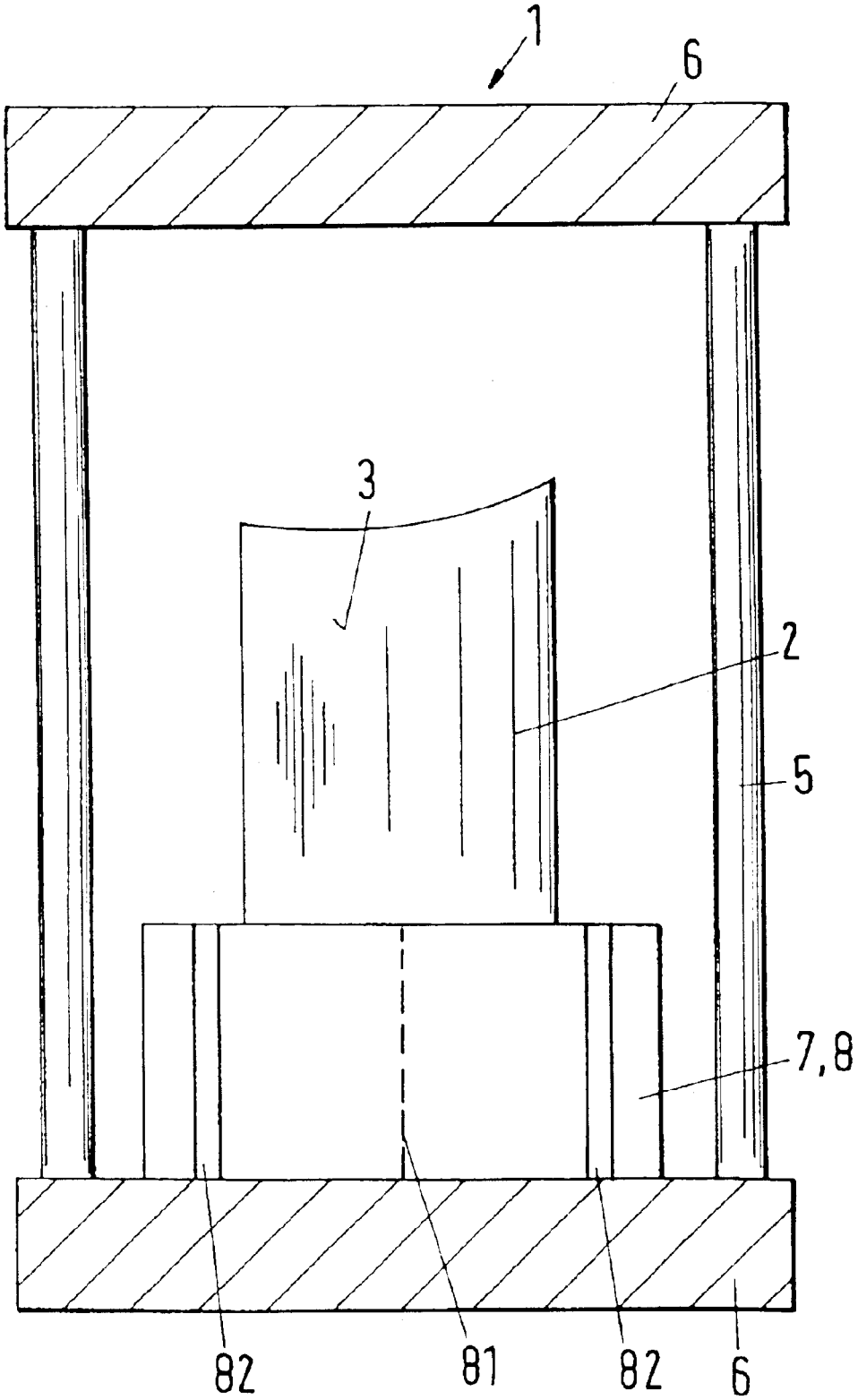
FIG. 1 shows, schematically, a guide apparatus with a holder and a cover member in section.

FIG. 1 shows in a schematic sectional representation a guide apparatus in accordance with the invention which is designated in the following as a whole with the reference numeral 1. The guide apparatus 1 includes two guide members 6 which are spaced apart by two spacers 5. Furthermore, the guide apparatus 1 has a holder 7 for the positioning of a workpiece 2 between the guide members 6, with the guide members 6 being arranged and designed such that the workpiece 2 is guidable in the polishing container 4 in a non-contact manner with respect to a polishing container 4 not shown in FIG. 1. In the embodiment shown in FIG. 1, the holder 7 includes a cover member 8 which allows a region of the surface 9 of the workpiece 2 to be covered which should not be polished. The cover member 8 is preferably made up of a suitable plastic, but can also be made, of other materials depending on the demands, with it generally being possible for a plurality of cover members 8 to be provided in order to cover different regions of the workpiece 2 which should not be polished. As indicated by the line 81, the cover member 8 is made in two parts and the workpiece 2 is fixed in the holder 7 by fastening means 82. The fastening means 82 can, as in the embodiment shown here, be realized by elastic plastic bands 82. Other fastening means 82 such as metal bands 82, which can be clamped with the aid of suitable devices for the fixing of the workpiece 2, can also be used or also screws 82, for example, or any other suitable fastening means 82 can advantageously be used, with the cover member 8 and/or the holder 7 also being designed to be dismantled in three parts or to include more than three parts. The cover member 8 and/or the holder 7 can in particular also be designed in one part.

Figure 2:
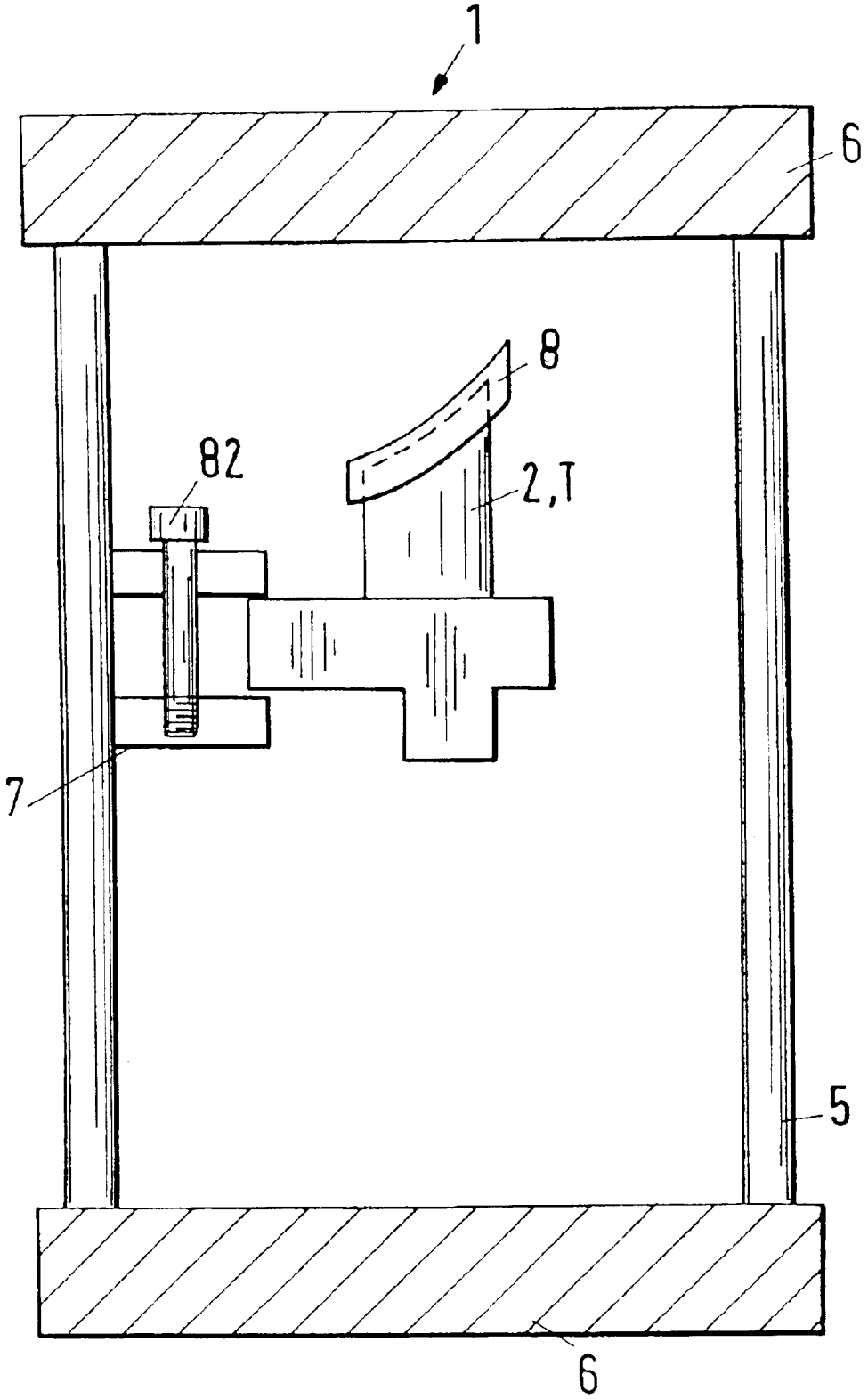
FIG. 2 shows, a further embodiment of the invention similar to FIG. 1.

In FIG. 2, a further embodiment in accordance with FIG. 1 is shown in which the holder 7 for the positioning of the workpiece 2, which is shown here by way of example as a turbine vane T, is fixed to a spacer 5 between the guide members 6. The cover member 8 is made in one piece in this embodiment and here serves for the covering of the blade tip of the turbine vane T, with—in another embodiment—further cover members 8 generally also being able to be provided. The holder 7 is made in a multiple of parts and the workpiece 2, i.e. the turbine vane T, is fixed in the holder 7 by screws 82, with other fastening means 82 also being able to be suitable.

It is possible for a plurality of holders 7 for the positioning of the workpiece 2 to be provided. For instance, the workpiece 2 can simultaneously be positioned between the spacers 5, for example, by a plurality of holders 7 of which a respective one or more is/are fixed to a respective guide member 6 and/or to a spacer 5.

Figure 3:
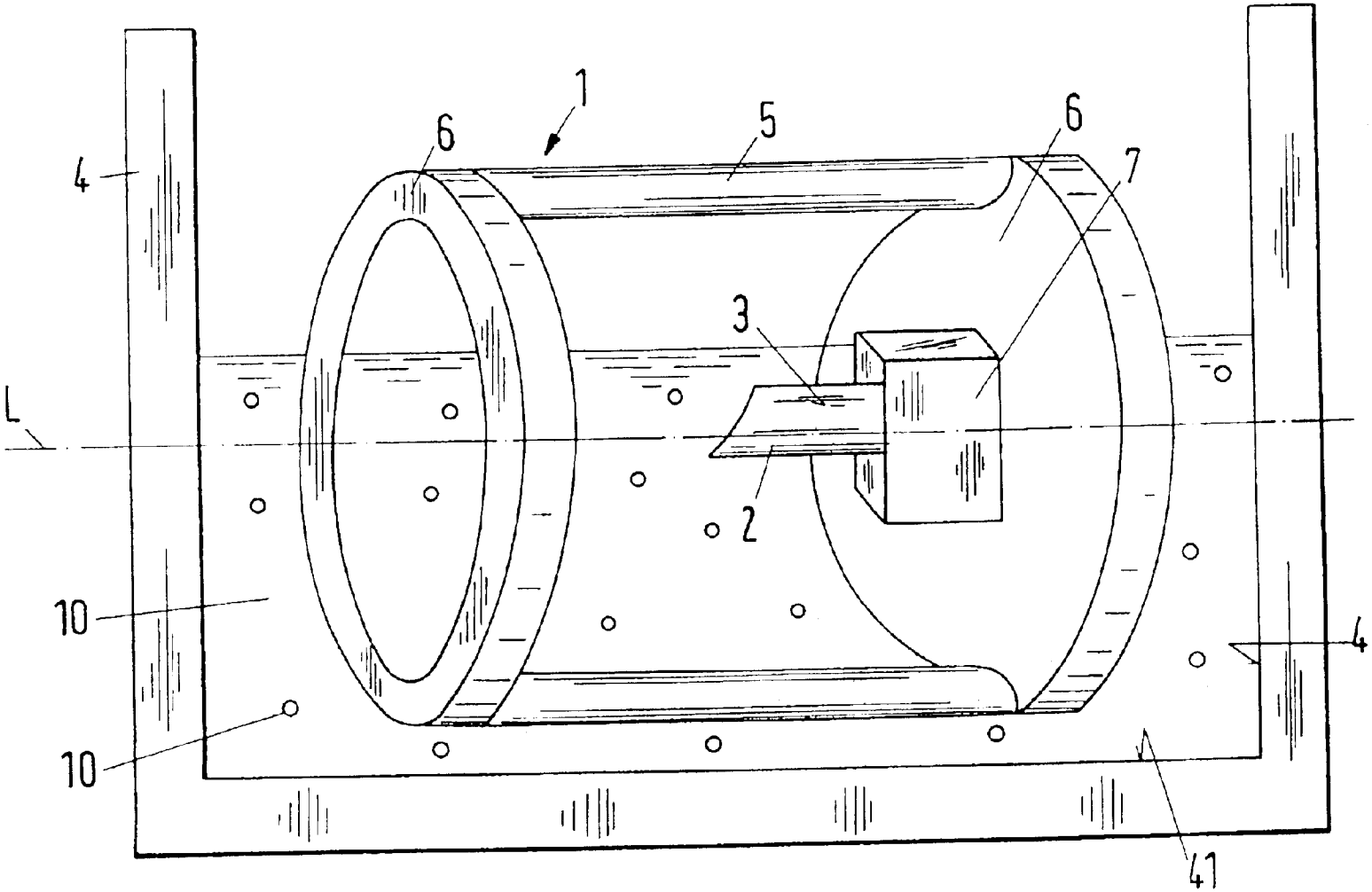
FIG. 3 shows an embodiment of a guide apparatus in accordance with FIG. 1 with a polishing container.

In FIG. 3, a preferred embodiment of a guide apparatus 1 is shown which guides a rotationally asymmetrical workpiece 2 in a polishing container 4. The two guide members 6 are each designed in ring shape or in the form of a circular disc, with the holder 7 being arranged with the workpiece 2 on the guide member 6 which is designed in the form of a circular disc. Both guide members 6 can also be designed as circular discs or in ring shape and it is moreover also possible for more than two guide members 6 to be provided. The guide members 6 are spaced apart by two spacers 5. In a special embodiment of the guide apparatus 1 made in accordance with the invention, only one spacer 5 can be provided for the spacing apart of the guide members 6. In particular, for example with heavy workpieces, more than two spacers 5 can also be provided. In the preferred embodiment of a guide apparatus 1 in accordance with the invention shown in FIG. 3, the two guide members 6 are arranged parallel to one another and are designed such that the guide apparatus 1 is freely rotatable about a longitudinal axis L which stands perpendicular to the guide members 6 and the workpiece 2 is guidable in the polishing container 4 such that the workpiece 2 does not come into contact with bounding walls 41 of the polishing container 4, with the guide apparatus 1 preferably being arranged in the polishing container 4 such that the longitudinal axis L stands substantially perpendicular to the direction of the acting gravity; i.e. the longitudinal axis L of the guide apparatus 1 lies substantially in the horizontal direction in accordance with the representation. It is also possible to position the guide apparatus 1 in any other desired orientation in the polishing container 4. In the present embodiment in accordance with FIG. 3, the polishing container 4, which contains polishing elements 10, is set into vibration by devices which are not shown such that the workpiece 2 is polished by the unordered movement of the polishing elements 10 which as a whole behave analogously to a viscid liquid. Due to the design of the guide apparatus 1, the guide apparatus 1 can carry out rotational movements about the longitudinal axis L such that a uniform roughness of the polished surfaces, in particular of the porous surface coating 3 of the workpiece 2, can be achieved.

Figure 4:
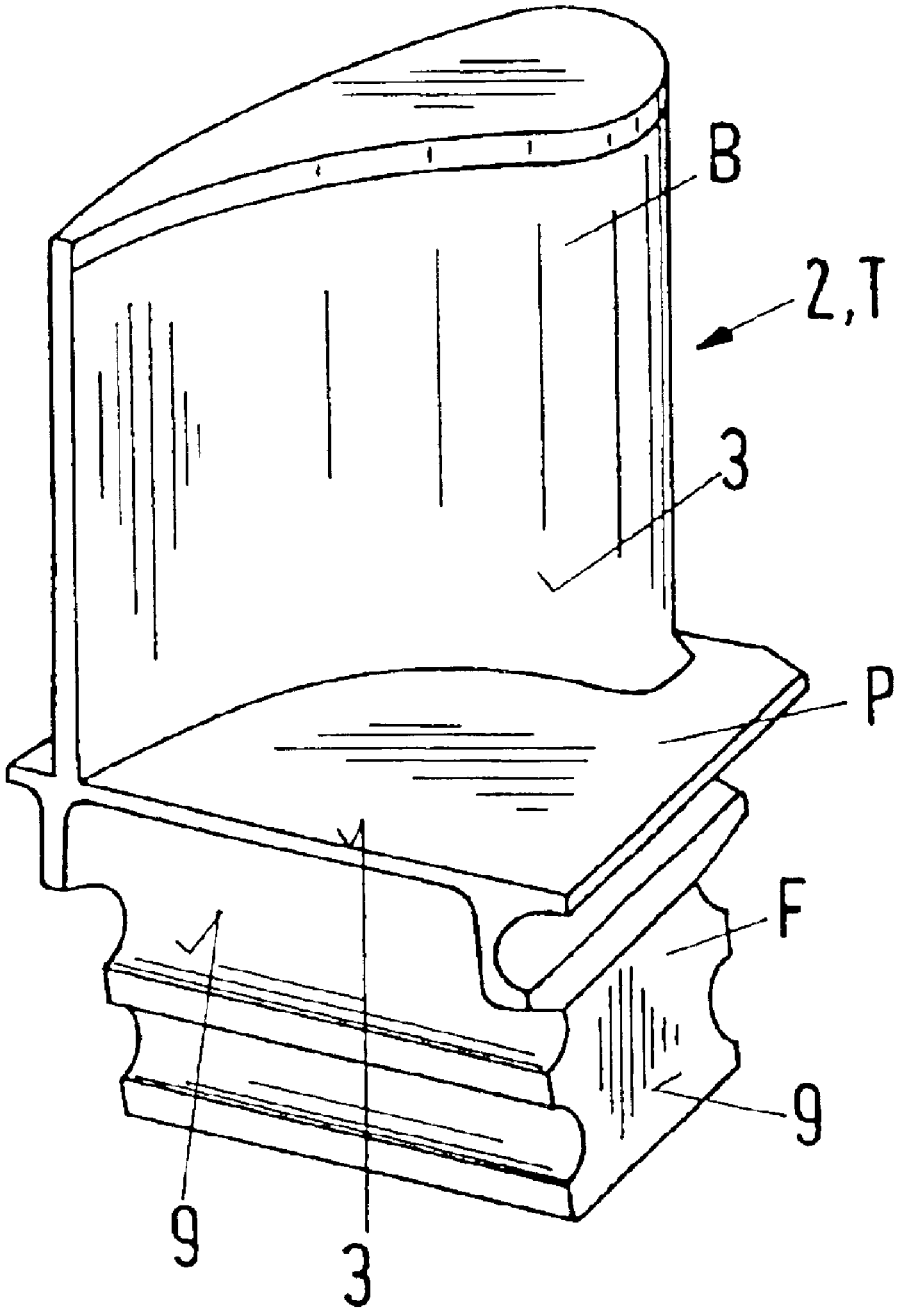
FIG. 4 shows a turbine vane with a porous heat insulating layer.

The guide apparatus 1 in accordance with the invention is preferably used in the polishing of a workpiece 2 in the form of a turbine vane T which can include a porous surface coating 3 in the form of a heat insulating layer 3. A turbine vane T is shown schematically in FIG. 4. The turbine vane T includes a foot section F with a foot plate P and a blade B, with the blade B and the foot plate P being provided with a porous surface coating 3, in particular with a ceramic heat insulating layer 3 based on $ZrO_2$, with the foot section F not having to be polished.

Figure 5:
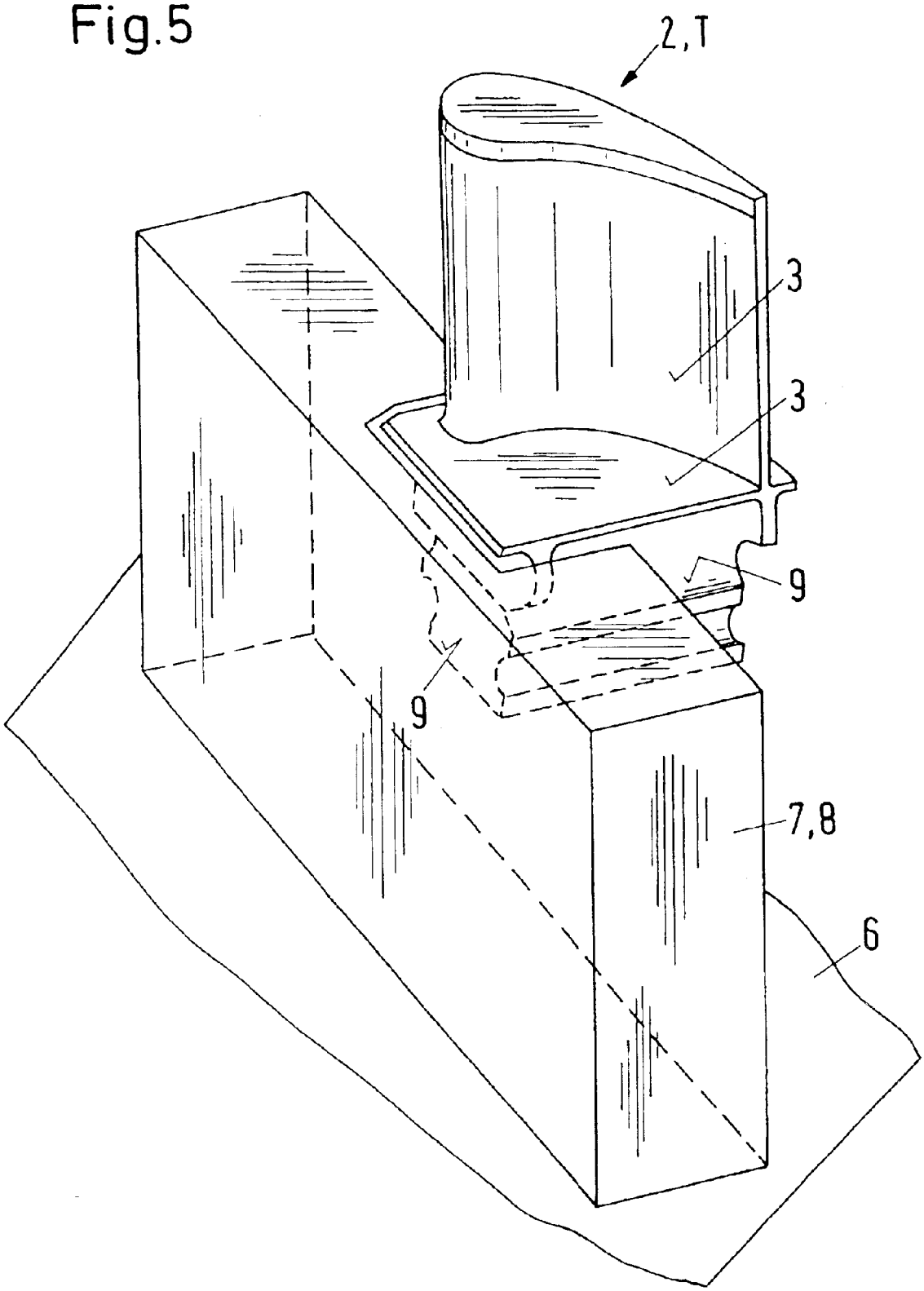
FIG. 5 shows a cover member which can be dismantled with a turbine vane.

For polishing, the turbine vane T is fixed, as shown by way of example in FIG. 5, in a holder 7 which simultaneously functions as a cover member 8. The cover member 8 is made in two parts in the embodiment shown in FIG. 5, with only that half of the cover member 8 being shown in FIG. 5 which is not fastened to the guide member 6 by fastening means 82 which are not shown. For polishing, the half of the cover element 8 shown in FIG. 5 is supplemented by a second half such that the foot section F is covered by the cover member 8 and the foot section F is thus not polished in the polishing process in the polishing container 4.

An apparatus and a method are thus made available in accordance with the invention for the polishing of a porous surface coating of rotationally asymmetrical workpieces, with the workpiece being able to be guided in a polishing container without any external fastening means on polishing. Unacceptably high mechanical strains on the workpiece are thereby effectively avoided which, in the worst case, can result in damage to the workpiece and/or to the surfaces to be treated. Moreover, the guide apparatus in accordance with the invention prevents the workpieces to be polished from coming into direct contact with the bounding walls of the polishing container, for example of a tray vibrator, with any partitioning slides present and/or with adjacent workpieces, whereby damage to the workpiece or to sensitive regions of the surface of the workpiece, in particular to edges, can practically be precluded. Damage of the kind described above can additionally be minimized by suitable masking in the form of cover members.

A further important advantage of the guide apparatus in accordance with the invention and of the method in accordance with the invention for the polishing of porous surface layers lies in the fact that, in particular with rotationally asymmetrical workpieces such as turbine vanes, sufficiently low surface roughnesses and/or surfaces polished to a high degree of uniformity can be produced. Since the guide apparatus can rotate with the workpiece uniformly about an axis between the polishing elements in the polishing container and since the differently oriented surfaces of the turbine blade are acted upon with a uniform polishing pressure by the polishing elements during polishing, the previously emphasized high quality of the polished surfaces is achieved.

What is claimed is:

1. A vibropolishing apparatus for a workpiece which has a porous surface coating comprising a polishing container and a guide apparatus disposed in the container for guiding and holding the workpiece in the polishing container, the guide apparatus having first and second guide members which are spaced apart by at least one spacer and a holder for positioning and holding the workpiece between the guide members, the guide apparatus being formed and disposed in the polishing container so that it is freely movable, freely rotatable and can take any position relative to the polishing container while preventing the workpiece from contacting the polishing container during polishing.

2. A guide apparatus in accordance with claim 1 wherein the guide members are arranged parallel to one another and have the shape of one of a ring and a circular disc.

3. A guide apparatus in accordance with claim 1 including a cover member for covering a surface region of the workpiece.

4. A guide apparatus in accordance with claim 3 wherein at least one of the holder and the cover member comprises multiple parts capable of being dismantled.

5. A method for polishing a porous surface layer of a workpiece comprising providing a guide apparatus for the workpiece having first and second guide members which are spaced apart by at least one spacer, the guide members and the spacer defining a protected space of the guide apparatus, providing a polishing container adapted to receive the guide apparatus in a constraint-free manner so that the guide apparatus is freely movable and can take any desired orientation relative to the polishing container, securing the workpiece to the guide apparatus so that the workpiece is disposed inside the protected space, placing the guide apparatus and the workpiece secured thereto inside the polishing container, placing a polishing medium inside the polishing container, and polishing the workpiece inside the polishing container, whereby contact between the workpiece in the protected space and the polishing container is prevented by the guide apparatus.

6. A method according to claim 5 including placing a plurality of guide apparatuses, each including a workpiece secured thereto, into the polishing container, and protecting the workpieces in the plurality of guide apparatuses with their respective guide apparatus against contacting the other guide apparatuses and other workpieces secured thereto.

7. A method according to claim 5 wherein the workpiece comprises a turbine vane crying the porous heat insulating layer.

8. A method according to claim 5 wherein the workpiece comprises a turbine vane, and wherein polishing the porous surface layer comprises polishing it so that the surface layer has a roughness of less than 15 $\mu$m.

9. A method according to claim 5 wherein polishing the surface layer comprises polishing it to a roughness of less than 8 $\mu$m.

10. A method according to claim 9 wherein polishing the surface layer comprises polishing the surface layer to a roughness of less than 4 $\mu$m.

11. A method in accordance with claim 5 wherein polishing comprises vibration polishing with the aid of polishing elements.

12. A method in accordance with claim 5 wherein the porous surface layer is a porous heat insulating layer.

13. A method according to claim 12 wherein the heat insulating layer is a ceramic heat insulating layer based on $CrO_2$.

14. Apparatus for polishing a workpiece comprising a polishing container, a guide apparatus for the workpiece having first and second guide members which are spaced apart by at least one spacer, the guide members and the spacer defining a protected space of the guide apparatus and being adapted to be placed inside the polishing container so that the guide apparatus is freely movable and can take any desired orientation relative to the polishing container, and a holder for securing the workpiece to the guide apparatus so that the workpiece is disposed inside the protected space whereby, during polishing when a polishing medium is inside the polishing container, the workpiece in the protected space is polished and the guide apparatus protects the workpiece against contacting any part of the polishing container.

* * * * *